United States Patent [19]

Selkirk

[11] 4,110,989

[45] Sep. 5, 1978

[54] PILING FABRICATED FROM SYNTHETIC MATERIAL

[76] Inventor: Thomas Selkirk, 61 Dictum Ct., Brooklyn, N.Y. 11229

[21] Appl. No.: 797,299

[22] Filed: May 16, 1977

[51] Int. Cl.[2] ..... E02D 5/32

[52] U.S. Cl. ..... 405/248; 405/255; 52/727

[58] Field of Search ..... 61/53, 53.74, 48; 256/19; 114/230; 52/727, 720, 731

[56] References Cited

U.S. PATENT DOCUMENTS

| | | | |
|---|---|---|---|
| 2,857,872 | 10/1958 | Usab | 61/48 X |
| 3,013,584 | 12/1961 | Reed et al. | 52/727 |
| 3,495,565 | 2/1970 | Gustavii | 114/230 |
| 3,636,718 | 1/1972 | Keats | 61/53.74 |
| 3,957,250 | 5/1976 | Murphy | 256/19 |

*Primary Examiner*—Jacob Shapiro
*Attorney, Agent, or Firm*—Friedman, Goodman & Teitelbaum

[57] ABSTRACT

A piling which can be embedded into a sand or mud bedding beneath a body of water and which includes a cylindrical body portion having a smooth exterior surface; the body portion being made of a synthetic material, preferably a polyvinyl chloride material. A longitudinal bore extends through the body portion to permit introduction of a fluid under pressure thereby facilitating the sinking of the piling into the bedding. After the piling is embedded, the bore is covered, thereby providing a space for resisting the forming of a vacuum in order to prevent loosening and releasing of the piling from the bedding.

7 Claims, 5 Drawing Figures

PILING FABRICATED FROM SYNTHETIC MATERIAL

BACKGROUND OF THE INVENTION

This invention relates to piling, and more particularly to an improved plastic, such as polyvinyl chloride, vacuum resisting pile.

Piling is typically utilized as the support for a dock or pier which extends over a body of water. The dock or pier will be supported by a number of such piles which are in turn embedded into the mud or sand beneath the water. Pilings are also sunk in water for anchoring boats as well as for enclosing or isolating restricted areas in a body of water. Because the piling is sunk in water, the piling material must be resistant to water corrosion and damage, and must last for a considerable period of time despite the harmful water and marine environment. At the same time, the piling material must be strong and durable, capable of supporting a great weight and capable of retaining its rigidity and shape despite stress and weight. Although metal or concrete piling is frequently utilized for support purposes on land, in a water environment these materials are usually avoided. The concrete piling is difficult to place beneath the water and therefore it is almost impossible to utilize concrete for such purposes. Most metal materials, which are strong enough and durable enough for such purposes, are also subject to corrosion when maintained in a water environment. To avoid such corrosion, the metal would first have to be treated with expensive coatings and costly processes to make them corrosive resistant. Additionally, those metals that are not corrosive, such as brass or bronze, would be prohibitively expensive for use in a typical piling for docks and piers.

As a result, the most commonly utilized material for piling in a water environment is solid wooden poles. These poles are relatively inexpensive and yet provide the necessary rigidity, durability, water resistance, and sufficient strength for supporting docks, piers, anchoring boats, etc. The wooden poles are generally not finished, but are retained in their rough state to reduce their cost even further. In supporting a dock or pier, numerous wooden piles are required and by utilizing the rough wooden poles, the cost for the piling is reduced as much as possible.

In installing the piling into the mud or sand bed, the piling is positioned over the desired location for sinking, and then hammered into the bed using a drive hammer, sledge hammer, or other source of hammer power. In some cases, a hose is connected to the outside of the wooden pile and compressed air is introduced to the lower edge of the piling to disperse the sand or mud, thereby facilitating sinking of the piling into the bed.

Although the cost of such wood piling is relatively inexpensive, its use has created numerous problems in maintenance and has necessitated frequent replacement of the piling. One of the biggest problems associated with the solid wood piling, or other similar prior art piles, is that they tend to loosen from their bed and after a while no longer provide the firmness and secure support which is needed. With continued use, the motion of the water, the movement of boats against the piles, the vibrations of the dock, and other forces push against the piles and they tend to loosen the sand or mud bed and destroy the firm base support for the piling. In many cases, the piling will be completely loosened from their base and will actually float freely in the water providing no support at all.

An additional problem concerning prior art piles is the relationship between the pile and dock or pier. The docks are generally floating, while the piles are stationary. Thus, as the docks or piers move up and down because of rising and falling tides, they tend to pull the piling up from their bed and loosen the piles.

A further problem existing with prior art piles concerns the changing water conditions, and specifically the formation of ice during cold weather. Ice generally forms at the surface of the water. The dock is also connected to the pile at about the surface of the water. As a result, just at the junction, ice will form on the pile and firmly connect the dock or pier to the pile. This will form a solid coupling and as the dock or pier moves, it will pull up the pile from its bed. Additionally, the use of wooden piles further complicates matters since the exterior surface of the wood piles is rough, irregular, and filled with cracks and crevaces. This roughness provides an excellent surface of ice adhesion and as a result, once the ice forms even the movement of the pier against the pile can not remove or break the ice formations, where movement of the ice will pull up or loosen the pile from its bed.

The rough exterior surface of the wood piling adds other problems as well. Many forms of marine life can attach itself to this rough exterior which tends to eat away and corrode the piling material. It also attracts various types of polluting material which then adheres to the piling and creates difficulties for docking boats.

When utilizing prior art piling, and especially of the wooden pole type, the piling is generally coated with an impervious material such as Creosote or other types of tar coating in order to make it water resistant. While this material may add to the life of the piling, it tends to pollute the water and presents an environmental problem.

A further problem existing with the prior art piling, especially of the wooden pole type, concerns the sizes available. Typically, wooden poles are provided in varied sizes. However, they cannot be precut to a desired shape without losing a lot of material. As a result, piles were utilized in irregular heights, and frequently a tall pile would extend upward over adjacent shorter piles thereby creating a hazard, as well as an eyesore. Irregular heights in the prior art are also caused by a pile, after being installed, further sinking into the bed after a period of time as a result of its own weight forcing the pile downwardly.

SUMMARY OF THE INVENTION

It is accordingly an object of the present invention to provide an improved piling which avoids the aforementioned problems of prior art piling.

Another object of the present invention is to provide an improved piling which contains a smooth exterior surface which avoids attachments of marine life and prevents gripping of ice thereto.

Still a further object of the present invention is to provide an improved piling formed of a synthetic material, such as plastic, preferably a polyvinyl chloride material which is non-corrosive and acid resistant, and provides a smooth exterior surface.

Another object of the present invention is to provide an improved piling which can be extruded at reasonable cost, and can be precut to size to thereby avoid waste of material.

Yet another object of the present invention is to provide an improved piling which utilizes a space for resisting the forming of a vacuum to aid in the retention of the piling in its embedded condition.

Still a further object of the present invention is to provide an improved piling which can be easily embedded by utilizing a fluid under pressure sent through the piling itself to aid in the sinking of the piling into the bedding.

A further object of the present invention is to provide an improved piling which substantially reduces the amount of ice formed on the piling during cold weather conditions.

Still another object of the present invention is to provide an improved piling which includes a guide sleeve for coupling the piling to a pier, and which aids in avoiding ice being formed on the piling.

A further object of the present invention is to provide an improved piling which includes a bore in the piling for facilitating sinking of the piling into the bedding, and for providing a space to resist the forming of a vacuum for holding of the piling in the bedding.

Yet a further object of the present invention is to provide an improved piling which can be cut and adjusted in situ thereby expediting the use and placement of the piling.

A further object of the present invention is to provide a method of sinking a piling, which method provides an improved retention of the piling in the bed.

Another object of the present invention is to provide an improved method of coupling a piling to a pier or dock to avoid ice forming and gripping onto the piling.

Briefly, the present invention provides for piling which comprises an elongated body portion having a longitudinal bore extending through the body portion. Means are provided for introducing a fluid under pressure through the bore to facilitate sinking of the lower end of the body portion into a bedding. A cover means is also provided for sealing the upper end of the body portion after the piling has been embedded. In an embodiment of the invention, the elongated body portion includes a smooth exterior surface.

Another teaching of the invention is a piling which comprises an elongated body portion having a smooth exterior surface, and wherein the body portion is formed of plastic, preferably a polyvinyl chloride material.

The present invention also teaches a method of embedding a piling comprised of an elongated body portion with a longitudinal bore extending through the body portion. The method includes the steps of placing the piling in position in closely spaced relationship with the bedding in which the piling is to be sunk. A fluid under pressure is passed through the longitudinal bore so that the bedding is loosened under the piling whereby sinking of the piling into the bedding is facilitated. Afte the piling is embedded, the upper end of the bore is sealed.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DESCRIPTION OF THE PREFERRED EMBODIMENT

Figure 5:
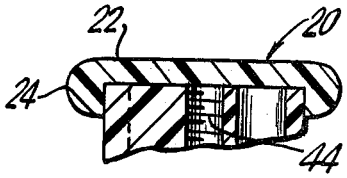
FIG. 5 is a partially sectioned elevational view taken along line 5—5 showing the upper ends of the piling and cover.

The piling of the present invention comprises an elongated body portion 10, shown as a cylindrical member. A longitudinal bore 12 is formed through the body portion and is shown located through the center thereof. Around the central bore 12 is placed at least one additional longitudinal passageway extending through the body portion and spaced from the bore 12. One such passageway 14 is formed in an approximately eliptical configuration, having its major diameter in a circumferential direction and its minor diameter in a radial direction. Two other similarly formed passageways 16 and 18, are also provided. The three passageways 14, 16 and 18 are symmetrically positioned around the central bore 12. A cover means, shown generally at 20 is provided for closing the top end of the body portion and sealing the longitudinal bore 12, as well as the passageways 14, 16 and 18. The cover means 20 is formed as a cap with a flat upper surface 22 and a downwardly depending peripheral edge 24 which can fit over the top end of the body portion 10, as best shown in FIG. 5.

Figure 1:
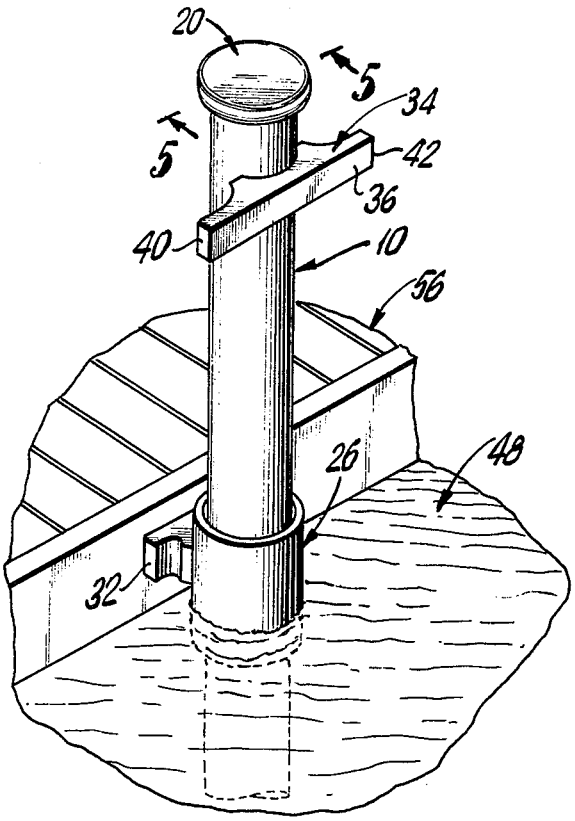
FIG. 1 is an isometric view of the piling inserted in a body of water and coupled to a dock or pier.
Figure 2:
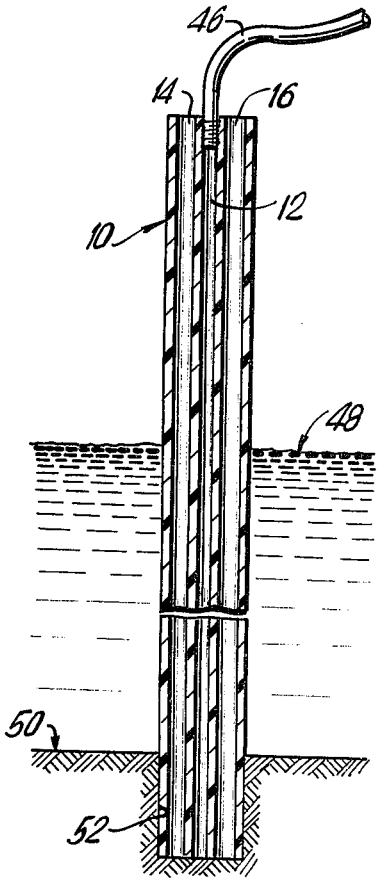
FIG. 2 is a sectioned elevational view of the piling shown embedded beneath the water.
Figure 3:
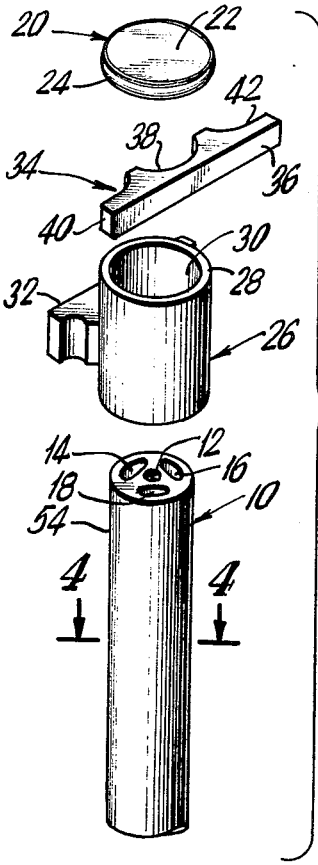
FIG. 3 is an exploded isometric view of the piling and associate components.
Figure 4:
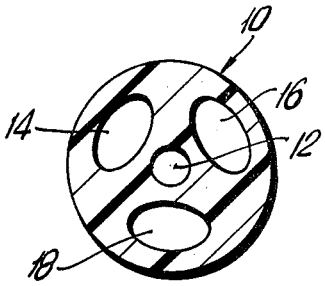
FIG. 4 is a plan sectional view taken along line 4—4 of FIG. 3.

A guide sleeve 26 is also provided, and includes a tubular body portion 28 having a central bore or opening 30 which can receive the piling body portion 10. The bore 30 is formed slightly larger than the external size of the piling to thereby provide a snug but sliding fit between the guide sleeve 26 and the piling 10, leaving very little clearance therebetween. A bracket 32 is connected to the tubular body portion 28, for attachment to a pier or dock, as shown in FIG. 1.

A cleat, shown generally at 34 is also provided. The cleat 34 includes a substantially flat front face 36 and an arcuately formed rear surface 38 which corresponds in shape to the periphery of the piling 10 so that the cleat can be coupled to the piling. Outwardly extending arms 40, 42 are available on the cleat for mooring a boat or connecting other structures to the piling.

An internally threaded portion 44 is formed in the top part of the piling bore 12 to accommodate the threaded end of a supply tube 46 through which a compressed fluid can be introduced into the longitudinal bore 12.

In sinking the pile, the pile 10 is placed into the water 48 in position over the bed 50 in which the pile is to be sunk. The pile is then lowered until it is adjacent to the mud or sand bed 50 in which it is to be located. The supply tube 46 is then connected to the longitudinal bore 12 by screwing the threaded end of the tube 46 into the internally threaded end 44 of the longitudinal bore 12 at the upper end of the body portion of the piling. A fluid under pressure, typically air or water, is then forced through the longitudinal bore and down through the entire body portion until it reaches the bed 50. The fluid under pressure issuing at the lower end of the body portion 10 will loosen the sand or mud and force it to pass therefrom in an upward direction with the escaping air or water, thereby forcing the elongated pile to be sucked into the vacated space 52 and move downwardly into the bed. Thus the piling sinks into the bed, being sucked into the space or opening 52 formed therein. The continued application of the fluid under pressure will facilitate the sinking of the piling. Additional external pressure or force may be applied to the piling as required in order to properly sink the piling.

When the piling has reached the depth desired, the fluid supply is stopped and the tube 46 is removed from the longitudinal bore, and the cover 20 is placed over the top end of the elongated body portion. The cover is constructed to have a tight fit over the elongated body portion so that it can be securely coupled by means of a press fit. Additionally, an adhesive such as cement, epoxy, caulking, etc., can be utilized either directly between the cover 20 and the top of the elongated body portion, or around the peripheral edge of the cover, to completely seal the central bore 12 as well as the passageways 14, 16 and 18.

As a result of sealing the bore and passageways, the air in those passageways and bore becomes trapped at its upper end by the cover and at its lower end by the sand, mud, etc., forming the bed. In this manner, any attempt to extract the piling from its position in the bed will be met by a resistance to form a vacuum within the bore and passageways, which would be created by increasing the space without adding anymore air into the space. This resistance to forming a vacuum will aid in the retention of the piling in position in its bed and will make the piling firmer and secure within its bedding. It will also prevent loosening of the piling from its surrounding bed. Because of the additional strength and retention provided by this resistance to form a vacuum within the passageways of the piling, it will not be necessary to insert the piling to as great a depth as prior art piling was required in order to achieve comparable support. With prior art piling, the pile had to be inserted at a greater depth to provide a secure retention in the bedding. However, with the aid of the bore and passageways of the present piling, being used as mentioned above, a similar amount of firmness and secure retention can be obtained with a reduced amount of sinking into the bed.

It will therefore be appreciated that the central bore forms a dual purpose. Firstly, it permits introduction of the fluid under pressure for aiding in the sinking of the piling into the bedding. At the same time, after its sinking, by sealing the bore there is provided a space which resists the forming of a vacuum, thus retaining the piling in the bedding. The passageways formed around the bore likewise form a dual purpose. On the one hand they also resist the forming of a vacuum therein in order to retain the piling in the bedding. At the same time, they reduce the amount of material needed in the piling and thereby reduce the cost and weight of the actual piling.

The piling is formed with a smooth exterior surface 54. Such smooth surface can be provided by making the piling out of a synthetic material, such as plastic, preferably a polyvinyl chloride material. Such material can easily be extruded, with the center bore and side passageways as shown, and can then be cut to an appropriate size. In fact, the actual length of the piling can be cut in situ. Thus, the piling can be brought in very great lengths to the sinking site and appropriate sizes cut in accordance with the desired amount of sinking. The threads in the longitudinal bore can then be formed in the top portion of the bore to accommodate the supply tube for introducing the fluid under pressure. In this way, the sizes of the piling do not have to be precut, and material is not wasted since the exact size will be cut in situ.

By forming the piling of polyvinyl chloride material additional unique benefits are obtained. Firstly, the material is of a nature which is non-corrosive, and is acid resistant. It will therefore be exceedingly durable and will not be harmed by the water environment. At the same time, because of its smooth exterior surface, marine life will not adhere itself to the piling and the piling will therefore last longer and avoid the collection of polluting material adjacent to a pier or dock.

The smooth exterior surface also aids in the long life of the piling by avoiding problems of icing during cold weather. Although ice may form at the surface around the piling, because of the smooth exterior surface, the ice will not adhere to the surface and can be easily slid off the exterior surface of the piling. For example, if the piling is directly connected to a dock or pier, the ice which typically interconnects the dock to the piling will not permanently stick to this piling because of its smooth exterior surface so that the piling can slide within the ice formation.

By utilizing the sleeve 26 to interconnect the piling to a dock 56, additional avoidance of icing conditions can be provided. The guide sleeve 26 can also be formed of polyvinyl chloride material. The sleeve is formed with a close tolerance allowance of the piling thereby not allowing ice buildup around the piling. The piling being a true pole, and the sleeve being a true shaftway with just the right amount of clearance to provide a snug fit, will permit the pole to move or slide up and down through the shaft but will not permit ice to form therebetween.

Typically, the sleeve 26 is placed around the elongated body portion and then the bracket 32 is connected to the dock or pier 56 is a conventional manner, such as by fastener means. The sleeve 26 is placed just at the water surface level with the water surface passing midway along the tubular body portion 28. Since the ice forms at the water surface level, the ice will form on the sleeve, and since no ice can form between the sleeve and the sliding elongated body portion 10 of the piling member, the ice will only be present on the outside of the sleeve and will not freeze to the piling itself. This will keep the piling free to pass within the sleeve and will not cause the ice to loosen the piling from its bedding.

The sleeve guide 26 can be formed with different types of bracket flanges 32, making it adaptable to meet various situations and various types of docks and piers. The bracket can be secured to the body portion 28 by any suitable means, such as a commercially available adhesive.

By making the piling out of polyvinyl chloride material, the material itself is inherently water resistant and no additional tar, Creosote or other coating need be placed on the exterior surface of the piling, and thereby pollution of the water is avoided.

Furthermore, the piling of the present invention fabricated from the polyvinyl chloride material is lighter weight than the piling of the prior art, where the central bore and passageways extending therethrough make the piling of the present invention even more lighter than the prior art. Thus, there is less tendency for the piling of the present invention to further sink into the bed after a period of time as a result of its own weight, which is a disadvantage of the prior art mentioned above. Therefore, the piling of the present invention is more likely to remain in its embedded stationary position after long periods of time than the piling of the prior art.

The cleat can be coupled by any suitable means, such as by an adhesive, to the piling at any convenient position, if desired, so that boats can be anchored to the dock by means of tying ropes extending from the boat to around the cleats. Because of the use of polyvinyl chloride material for the piling and sleeve, as well as for the cleats, it should be noted that the use of nails, screws, and other corrosive material can be avoided, and instead chemical adherence such as epoxy, cement, etc., can be utilized to connect these and other like accessories. This avoids the possibility of having the nails and screws corrode and loosen any accessories connected to the pile.

Although the external supply tube has been shown as being coupled by means of a screw thread, it will be understood that other types of coupling devices could easily be utilized to connect and introduce the fluid under pressure to pass through the longitudinal bore 12.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A piling comprising a cylindrical, one-piece, elongated body portion having a uniform cross section throughout its length; said body portion consisting of a non-corrosive, acid resistant, synthetic material; said body portion having a smooth and uniform exterior surface; a longitudinal bore extending through said body portion; said bore providing a column of air space walled by said synthetic material of said body portion; means for introducing a fluid under pressure through said bore to facilitate sinking a lower end of said body portion into a bed; a plurality of longitudinal passageways extending through said body portion; said passageways being positioned around said bore; said passageways providing additional columns of air space walled by said synthetic material of said body portion; and cover means sealing upper ends of said bore and passageways for trapping said columns of air space within said bore and passageways to retain said body portion in the bed, whereby any attempt to extract said piling from its position in the bed is met by a resistance to form a vacuum within said bore and passageways which are sealed by said cover means at one end and the bed at an opposite end thereof.

2. A piling as in claim 1, wherein said synthetic material is a polyvinyl chloride material.

3. A piling as in claim 1, wherein said passageways are approximately elliptical in cross section and symmetrically positioned around said bore.

4. A piling as in claim 1, wherein said means for introducing the fluid includes an internally threaded section in a wall of said bore at said upper end thereof for removably receiving a threaded end of a supply tube.

5. A piling as in claim 4, wherein said cover means includes a cap having a flat upper surface and a downwardly depending peripheral edge for tightly fitting over a top end of said body portion, and sealing means for sealing said cap in place.

6. A piling as in claim 1, further comprising a guide sleeve having a bore for slidingly receiving said body portion therethrough, said guide sleeve including a mounting bracket for coupling to a pier.

7. A piling as in claim 6, further comprising cleat means coupled to said body portion and substantially transverse thereto, said cleat means being disposed above said guide sleeve and below said cover means.

* * * * *